US008973383B2

(12) United States Patent
Sakami

(10) Patent No.: US 8,973,383 B2
(45) Date of Patent: Mar. 10, 2015

(54) HUMIDITY CONTROL APPARATUS, ENVIRONMENT TEST APPARATUS, AND TEMPERATURE AND HUMIDITY CONTROL APPARATUS

(75) Inventor: Shinichirou Sakami, Osaka (JP)

(73) Assignee: Espec Corp. (JP)

( * ) Notice: Subject to any disclaimer, the term of this patent is extended or adjusted under 35 U.S.C. 154(b) by 1515 days.

(21) Appl. No.: 12/595,958

(22) PCT Filed: May 12, 2008

(86) PCT No.: PCT/JP2008/058740

§ 371 (c)(1),
(2), (4) Date: Oct. 15, 2009

(87) PCT Pub. No.: WO2008/140072

PCT Pub. Date: Nov. 20, 2008

(65) Prior Publication Data

US 2010/0127089 A1 May 27, 2010

(30) Foreign Application Priority Data

May 15, 2007 (JP) ..... 2007-129301

(51) Int. Cl.
*F24F 3/14* (2006.01)
*F24F 5/00* (2006.01)
*F24F 11/00* (2006.01)

(52) U.S. Cl.
CPC ..... *F24F 3/14* (2013.01); *F24F 5/0042* (2013.01); *F24F 11/0008* (2013.01)
USPC ..... 62/176.6; 62/180; 62/186; 62/271; 62/91; 62/92; 62/93; 261/130

(58) Field of Classification Search
CPC ..... F24F 3/14; F24F 5/0042; F24F 11/0008
USPC ..... 62/176.6, 180, 186, 271, 91, 92, 93; 261/130
See application file for complete search history.

(56) References Cited

U.S. PATENT DOCUMENTS 4,586,342 A * 5/1986 Morishita et al. ..... 62/3.4
5,845,702 A * 12/1998 Dinh ..... 165/104.21

(Continued)

FOREIGN PATENT DOCUMENTS

JP 58-43343 3/1983
JP 63-69923 5/1988

(Continued)

*Primary Examiner* — Frantz Jules
*Assistant Examiner* — Azim Abdur Rahim
(74) *Attorney, Agent, or Firm* — Gerald E. Hespos; Michael J. Porco; Matthew T. Hespos

(57) ABSTRACT

A humidity control apparatus has a humidity control apparatus having a humidifying part for humidifying air and a dehumidifying part for dehumidifying to control humidity of a humidity control space. The dehumidifying part has: a main body part that is configured to encapsulate a working fluid therein and to cause a heat-pipe phenomenon. A heat-insulating part fits externally to the main body part and a heat absorption part absorbs heat from a base side part located on one side of the main body part in relation to the heat-insulating part and thereby condenses the working fluid that evaporated into gas in a front side part located on the other side of the main body part in relation to the heat-insulating part. The dehumidifying part dehumidifies the air by means of the front side part of the main body part where the working fluid in liquid form evaporates.

8 Claims, 7 Drawing Sheets

(56) References Cited

U.S. PATENT DOCUMENTS

| | | | | |
|---|---|---|---|---|
| RE37,464 | E * | 12/2001 | Meckler | 62/93 |
| 6,732,538 | B2 * | 5/2004 | Trigiani et al. | 62/129 |
| 2006/0086111 | A1 * | 4/2006 | Kang et al. | 62/176.6 |

FOREIGN PATENT DOCUMENTS

| | | |
|---|---|---|
| JP | 6-304393 | 11/1994 |
| JP | 735971 | 4/1995 |
| JP | 11-141955 | 5/1999 |
| JP | 11-142558 | 5/1999 |
| JP | 2001-136944 | 5/2001 |
| JP | 2004-169943 | 6/2004 |
| JP | 2005-49059 | 2/2005 |
| JP | 2006-29598 | 2/2006 |
| JP | 2006-118822 | 5/2006 |
| JP | 2006-145204 | 6/2006 |

* cited by examiner

HUMIDITY CONTROL APPARATUS, ENVIRONMENT TEST APPARATUS, AND TEMPERATURE AND HUMIDITY CONTROL APPARATUS

BACKGROUND OF THE INVENTION

1. Field of the Invention

The present invention relates to a humidity control apparatus, an environment test apparatus, and a temperature and humidity control apparatus.

2. Description of the Related Art

A variety of humidity control apparatuses for controlling the humidity of a predetermined humidity control space are known. Such humidity control apparatuses are provided with a humidifying part for humidifying the air sent to a humidity control space and a dehumidifying part for dehumidifying this air, wherein the humidity of the humidity control space is controlled by controlling the humidification capacity of the humidifying part and the dehumidification capacity of the dehumidifying part. Various configurations are applied as the dehumidifying part of such humidity control apparatuses. For example, the dehumidifier disclosed in JP 2001-136944 or JP 6-304393 can be applied as the dehumidifying part.

Specifically, the dehumidifier disclosed in JP 2001-136944 is a vapor-compression dehumidifier that has an evaporator (cooler) and a condenser and performs dehumidification by evaporating the moisture in the air on the evaporator. The dehumidified air is heated to the temperature close to the room temperature by the condenser and returned to a drying chamber.

In the dehumidifier disclosed in JP 6-304393, a heat absorption part of a peltier element is disposed on the air absorbing side, and a heat release part of the peltier element is disposed on the air emission side. Moist air is cooled by the heat absorption part of the peltier element and builds up dew condensation. Consequently, the air is dehumidified.

The cooling capacity and the dehumidification capacity of the dehumidifier disclosed in Patent Document 1 are great due to its vapor compression configuration, but the problem is that a large amount of power is required to drive this dehumidifier. The sensible heat factor (SHF) of the evaporator is approximately 0.8, and the ratio of a sensible heat load to a latent heat load is large. For this reason, the vapor-compression dehumidifier does not necessarily have a high dehumidifying efficiency but has a great dehumidification capacity.

On the other hand, in the configuration disclosed in JP 6-304393 where the moisture in the air is condensed by cooling the air by means of the heat absorption part of the peltier element, the required power is small, but the problem is that the capacity for cooling the air and the dehumidifying efficiency are low.

Therefore, a problem in applying the dehumidifier of JP 2001-136944 or JP 6-304393, which has a low dehumidifying efficiency, to a dehumidifying part of a humidity control apparatus is that the power for driving the humidity control apparatus increases and the dehumidifying efficiency of the dehumidifying part decreases.

SUMMARY OF THE INVENTION

The present invention was contrived in order to solve the problems described above, and an object of the present invention is to provide a humidity control apparatus, an environment test apparatus and a temperature and humidity control apparatus, which are capable of improving the dehumidifying efficiency of a dehumidifying part while reducing the driving power.

In order to achieve the above object, the humidity control apparatus according to the present invention is a humidity control apparatus having a humidifying part for humidifying air and a dehumidifying part for dehumidifying air, and for controlling the humidity of a humidity control space by means of the humidifying part and the dehumidifying part, wherein the dehumidifying part has a main body part that is configured to encapsulate a working fluid therein and to cause a heat-pipe phenomenon, a heat-insulating part fitted externally to the main body part, and a heat absorption part that absorbs heat from a base side part located on one side of the main body part in relation to the heat-insulating part and thereby condenses the working fluid that evaporated into gas in a front side part located on the other side of the main body part in relation to the heat-insulating part, and wherein the dehumidifying part dehumidifies the air by means of condensation of moisture on a surface of the front side part of the main body part where the working fluid in liquid form evaporates therein.

In addition, the humidity control apparatus according to the present invention is a humidity control apparatus having a humidifying part for humidifying air and a dehumidifying part for dehumidifying air, and for controlling the humidity of a humidity control space by means of the humidifying part and the dehumidifying part, wherein the dehumidifying part has a main body part that is configured to encapsulate a working fluid therein and to cause a heat-pipe phenomenon and disposed across a dehumidifying space for dehumidifying air to be fed to the humidity control space and an external space that is spaced from the dehumidifying space by a heat-insulating part and has a temperature lower than that of the dehumidifying space, and wherein the dehumidifying part dehumidifies air of the dehumidifying space by means of condensation of moisture on a surface of one side part of the main body part which is disposed in the dehumidifying space and where the working fluid in liquid form evaporates therein.

The environment test apparatus according to the present invention is an environment test apparatus having the humidity control apparatus described above.

The temperature and humidity control apparatus according to the present invention is a temperature and humidity control apparatus having the humidity control apparatus described above and a temperature control unit for controlling a temperature of the air, wherein the humidity of the humidity control space is controlled by the humidity control apparatus, and the temperature of the humidity control space is controlled by the temperature control unit.

DETAILED DESCRIPTION OF THE PREFERRED EMBODIMENTS

Embodiments of the present invention are described hereinafter with reference to the drawings.

First Embodiment

First, a configuration of a temperature and humidity control apparatus according to a first embodiment of the present invention is described with reference to FIG. 1 and FIG. 2.

Figure 1:
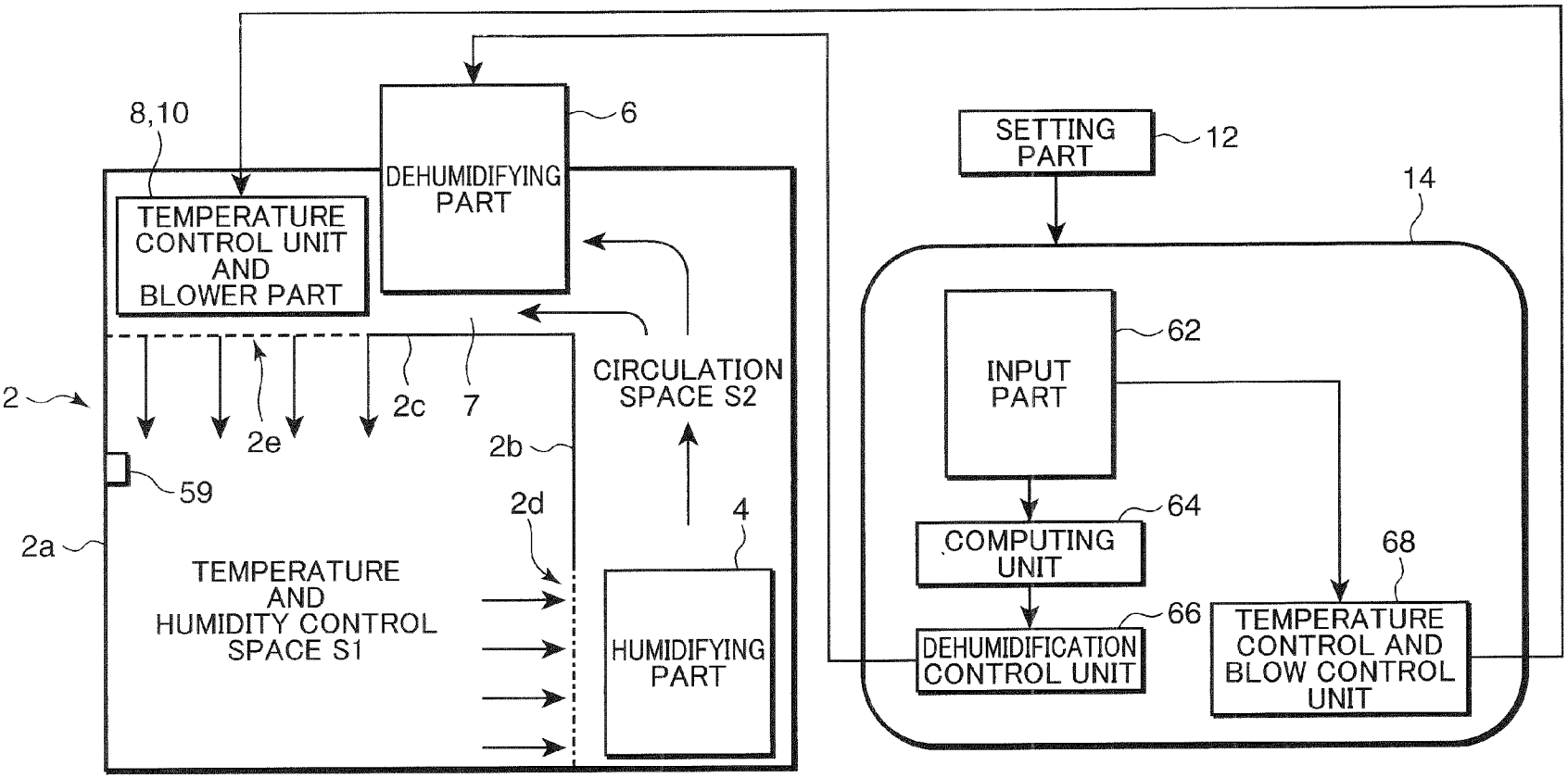
FIG. 1 is a block diagram schematically showing a configuration of a temperature and humidity control apparatus according to a first embodiment of the present invention.

The temperature and humidity control apparatus according to the first embodiment has a housing 2, a humidifying part 4, a dehumidifying part 6, a temperature control unit 8, a blower part 10, setting part 12, and controller 14, as shown in FIG. 1.

The housing 2 having a box shaped contour has an outer wall 2*a* having a heat-insulating material and inner walls 2*b*, 2*c* partitioning the space inside the housing 2. The box shaped contour of the housing 2 is configured by the outer wall 2*a*. A rectangular temperature and humidity control space S1 is formed by the inner walls 2*b*, 2*c* in the space within the housing 2. Both the inner walls 2*b*, 2*c* are disposed at right angles to each other, and end parts thereof are connected to each other. A circulation space S2 is provided outside the temperature and humidity control space S1 within the housing 2. In other words, the temperature and humidity control space S1 and the circulation space S2 are spaced from each other by the inner walls 2*b*, 2*c*. The circulation space S2 is bent along a side surface of the temperature and humidity control space S1. One of the inner walls, the inner wall 2*b*, is provided with a discharge port 2*d* for discharging air from the temperature and humidity control space S1 to the circulation space S2. The other inner wall, the inner wall 2*c*, is provided with a feed port 2*e* for feeding the air from the circulation space S2 to the temperature and humidity control space S1. The air that is discharged from the temperature and humidity control space S1 to the circulation space S2 via the discharge port 2*d* is subjected to temperature control and humidity control in the process of flowing through the circulation space S2, and is then fed into the temperature and humidity control space S1 via the feed port 2*e*. Specifically, the air within the temperature and humidity control space S1 circulates through the circulation space S2 while being subjected to the temperature control and the humidity control.

The humidifying part 4 humidifies the air. The humidifying part 4 installed in the vicinity of the discharge port 2*d* in the circulation space S2 humidifies the air discharged from the temperature and humidity control space S1 via the discharge port 2*d* and sends the humidified air to the downstream side.

The dehumidifying part 6 dehumidifies the air humidified by the humidifying part 4, to a set humidity, and then sends the dehumidified air to the temperature and humidity control space S1 side. In the first embodiment, the dehumidifying part 6 and the humidifying part 4 control the humidity of the temperature and humidity control space S1 to the set humidity. The dehumidifying part 6 is installed in a section in the circulation space S2 that extends toward the downstream side from the section installed with the humidifying part 4 and bends perpendicularly. A bypass 7 for causing the air to flow toward the downstream side without passing it through the dehumidifying part 6 is installed in the circulation space S2.

Figure 2:
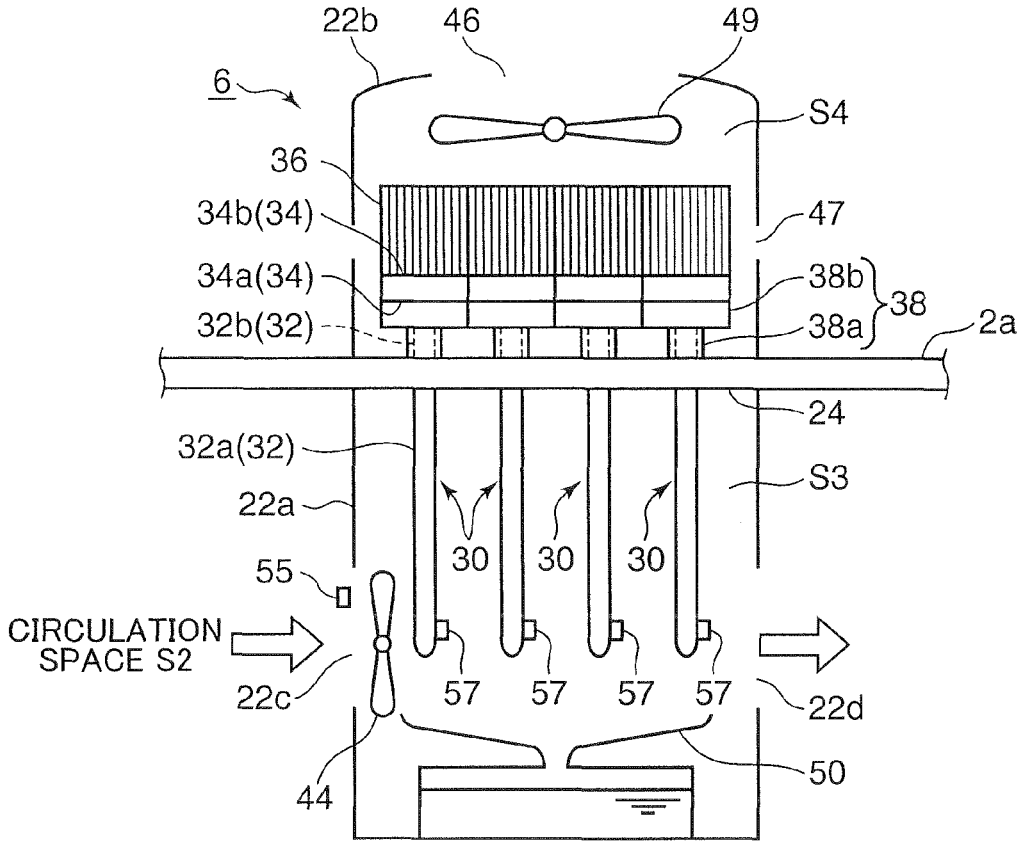
FIG. 2 is a diagram schematically showing a structure of the inside of a dehumidifying part of the temperature and humidity control apparatus shown in FIG. 1.

The internal structure of the dehumidifying part 6 is shown in FIG. 2. Specifically, the dehumidifying part 6 has a dehumidifying part internal housing 22*a* disposed within the circulation space S2, and a dehumidifying part external housing 22*b* disposed outside the housing 2. A heat-insulating part 24 is disposed between the dehumidifying part internal housing 22*a* and the dehumidifying part external housing 22*b*. The heat-insulating part 24 is formed into a plate and provided with a plurality of through-holes. The heat-insulating part 24 is formed by using a part of the outer wall 2*a* of the housing 2. A dehumidifying space S3 is provided within the dehumidifying part internal housing 22*a*, and a heat release space S4 is provided within the dehumidifying part external housing 22*b*. The dehumidifying space S3 and the heat release space S4 are spaced from each other by the heat-insulating part 24. The air is fed from the humidifying part 4 to the dehumidifying space S3. The air is dehumidified in the dehumidifying space S3 to the set humidity. The heat release space S4 is a space for releasing heat generated in the dehumidifying space S3. The dehumidifying part internal housing 22*a* is provided with an intake port 22*c* for taking the air sent from the humidifying part 4 into the dehumidifying space S3, and a discharge port 22*d* for discharging the air fed to the dehumidifying space S3 to the downstream side of the circulation space S2, that is, the temperature control unit 8 side. The intake port 22*c* and the discharge port 22*d* are provided to face the dehumidifying space S3. An upper opening 46 and a side opening 47 are provided to face the heat release space S4 in the dehumidifying part external housing 22*b*. The upper opening 46 is an opening for discharging the air within the heat release space S4 to the outside. The side opening 47 is an opening for feeding the outside air into the heat release space S4.

Dehumidifying modules 30 are disposed inside the dehumidifying part internal housing 22*a* and the dehumidifying part external housing 22*b*. The dehumidifying modules 30 are modules for eliminating the moisture contained in the air fed to the dehumidifying space S3, and a plurality of the modules are provided in the first embodiment. Note that only one of the dehumidifying modules 30 may be provided. Each of the dehumidifying modules 30 has a rod-shaped main body part 32 extending in one direction and a peltier element 34 provided on an end part of the main body part 32. The main body part 32 is configured by a heat pipe. In other words, the main body part 32 is configured to encapsulate therein water as a working fluid in a pressure-reduced state and to cause a heat-pipe phenomenon. The heat-pipe phenomenon here means a phenomenon in which the heat of the working fluid is transmitted as the working fluid transits from the section where it evaporates to the section where it is condensed, by repeating evaporation and condensation of the encapsulated working fluid in a predetermined place.

Each main body part 32 is disposed such as to extend vertically, and is inserted into each through-hole of the heat-insulating part 24. In other words, the main body part 32 has a front side part 32*a* located below the heat-insulating part 24 and disposed within the dehumidifying space S3 and a base side part 32*b* located above the heat-insulating part 24 and disposed within the heat release space S4, and the heat-insulating part 24 is fitted externally to a section between the front side part 32*a* and the base side part 32*b* in the main body part 32.

The peltier element 34 has a heat absorption part 34*a* and a heat release part 34*b*. The peltier element 34 is supplied with electricity, and, in response to the input electricity, the heat absorption part 34*a* performs a heat absorption operation, while the heat release part 34*b* performs a heat release operation. The heat absorption part 34*a* of the peltier element 34 is thermally connected to the base side part 32*b* of the main body part 32. The heat absorption part 34*a* of the peltier element 34 condenses a gas-phase working fluid in the base side part 32*b* of the main body part 32, and the heat-pipe phenomenon is caused in the main body part 32 as a result of the heat absorption operation performed by the peltier element 34. At this moment, the heat-pipe phenomenon is caused in the main body part 32, simply by controlling the heat absorption operation of the heat absorption part 34*a* of the peltier element 34 roughly, such that a temperature difference of approximately 10° C. is obtained between the front side part 32*a* and the base side part 32*b* of the main body part 32.

The heat release part 34*b* of the peltier element 34, on the other hand, is thermally connected to a heatsink 36 serving as heat release means. The heatsink 36 is used for releasing the heat of the heat release part 34*b* of the peltier element 34. Note that not only the heatsink 36 but a fin or the like may be used as the heat release means.

The base side part 32*b* of the main body part 32 and the peltier element 34 are joined to each other by a connection part 38. The connection part 38 is provided integrally with a cylindrical part 38*a* into which the base side part 32*b* of the main body part 32 is inserted, and a plate-like part 38*b* joined to the heat absorption part 34*a* of the peltier element 34. The connection part 38 connects the base side part 32*b* of the main body part 32 and the heat absorption part 34*a* of the peltier element 34 to each other rigidly and thermally.

A fan 44 is disposed in the dehumidifying space S3, and a flow of the air flowing from the intake port 22*c* to the discharge port 22*d* is formed in the dehumidifying space S3 by driving this fan 44. Then, the front side part 32*a* of the main body part 32 is positioned in this airflow. As a result, the moisture that is contained in the air fed to the dehumidifying space S3 is brought into contact with the front side part 32*a* of the main body part 32.

A fan 49 is disposed in the heat release space S4. While the outside air is fed to the heat release space S4 via the side opening 47 by driving this fan 49, the air heated in the heat release space S4 is discharged through the upper opening 46.

The dehumidifying space S3 is provided with a recovery part 50 for recovering the moisture condensed on the surface of the main body part 32. The recovery part 50 is disposed on the lower side of the main body part 32 and receives and recovers the moisture dropping from the main body part 32.

The humidifying part 6 is provided with an air temperature sensor 55 for detecting the temperature of the air fed from the humidifying part 4 via the circulation space S2, and an external surface temperature sensor 57 for detecting the external surface temperature of the front side part 32*a* of the main body part 32.

The air temperature sensor 55 falls into the concept of an air temperature detecting unit of the present invention. This air temperature sensor 55, disposed in the vicinity of the intake port 22*c*, detects the temperature of the air fed into the dehumidifying space S3 and outputs a signal corresponding to the result of the detection.

The external surface temperature sensor 57 falls into the concept of main body temperature deriving part according to the present invention. The external surface temperature sensor 57 is attached to an external surface in the vicinity of an end part of the front side part 32*a* of the main body part 32. Specifically, the external surface temperature sensor 57 is attached to an external surface of the section in the front side part 32*a* where the working fluid in liquid form accumulates when the heat-pipe phenomenon is caused completely in the main body part 32. In other words, when the heat-pipe phenomenon is started in the main body part 32, the liquid working fluid accumulated in the front side part 32*a* evaporates gradually, and consequently the fluid level of the working fluid is lowered. When the heat-pipe phenomenon is completely caused in the main body part 32, the fluid level of the working fluid becomes the lowest. It is desired that the external surface temperature sensor 57 be attached to the external surface of the front side part 32*a* that is lower than the fluid level of the working fluid at this moment, and within a range where the liquid working fluid is accumulated. The external surface temperature sensor 57 then detects the external surface temperature of the section where the external surface temperature sensor 57 is attached, and outputs a signal corresponding to the result of the detection.

Here, the external surface temperature of the section in the front side part 32*a* of the main body part 32 where the external surface temperature sensor 57 is attached becomes equal to the dew-point temperature of the dehumidifying space S3 at the point of time when dew condensation starts to build up on the surface of this section where the external surface temperature sensor 57 is attached, and thereafter this external surface temperature settles at the wet-bulb temperature of the dehumidifying space S3 after a lapse of a predetermined time period. This phenomenon is assumed to be caused by the following principle. Specifically, first, the external surface temperature of the section in the front side part 32*a* where the external surface temperature sensor 57 is attached becomes equal to the dew-point temperature, whereby dew condensation starts to build up on the surface of the section where the external surface temperature sensor 57 is attached. Thereafter, when the amount of dew condensation increases on the surface of the section where the external surface temperature sensor 57 is attached, condensation latent heat of the water vapor starts rising the temperature of the section where the external surface temperature sensor 57 is attached, whereby a part of the dew condensation evaporates. As a result, the external surface temperature of the section where the external surface temperature sensor 57 is attached settles at the wet-bulb temperature of the dehumidifying space S3. Note that this phenomenon is caused when the heat absorption operation performed by the heat absorption part 34*a* of the peltier element 34 is controlled such that a temperature difference of approximately 10° C. is obtained between the front side part 32*a* and the base side part 32*b* of the main body part 32, as described above. Due to this phenomenon, the external surface temperature sensor 57 first outputs a signal corresponding to the dew-point temperature of the dehumidifying space S3, and then a signal corresponding to the wet-bulb temperature of the dehumidifying space S3 after a lapse of a predetermined time period.

The following describes, based on the experiment carried out by the inventor of the present application, the fact that the external surface temperature of the section in the front side part 32*a* of the main body part 32 where the external surface temperature sensor 57 is attached becomes the wet-bulb temperature of the dehumidifying space S3 after a lapse of a predetermined time period as described above.

Figure 3:
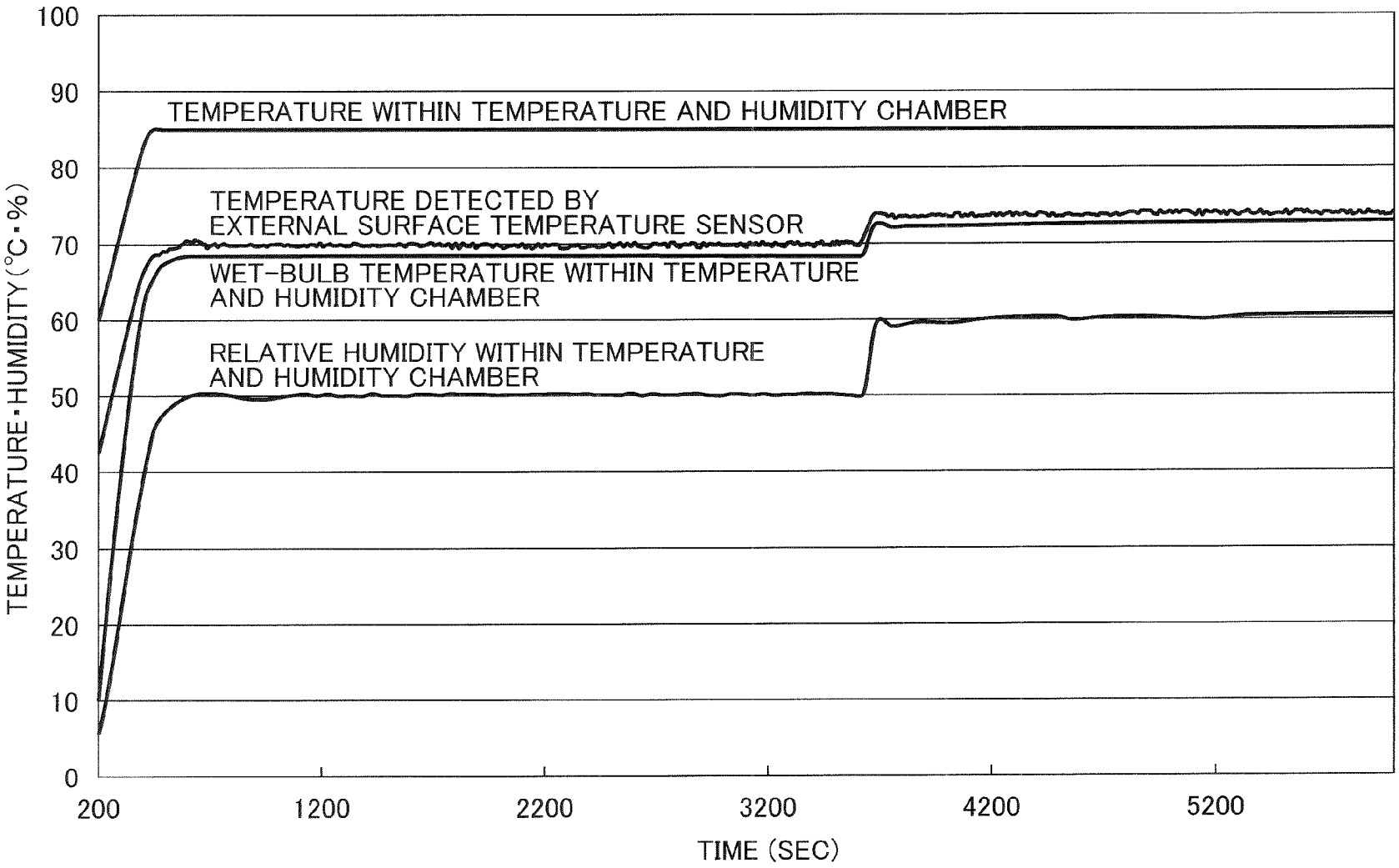
FIG. 3 is a diagram showing the result of temperature detected by an external surface temperature sensor of the dehumidifying part of the temperature and humidity control apparatus according to the first embodiment.

In this experiment, the dehumidifying modules 30 of the same configuration described above were installed in a temperature and humidity chamber, and the external surface temperature of the section in the front side part 32*a* of the main body part 32 where the liquid working fluid is accumulated is sequentially measured by the external surface temperature sensor 57, as well as the temperature, wet-bulb temperature, and relative humidity of a measurement space where the front side part 32*a* is disposed is measured by the temperature and humidity chamber. Note that in this experiment the measurement was performed in a state in which the measurement space within the temperature and humidity chamber was held under a predetermined constant-temperature constant humidity condition, that is, a condition of the range of temperature 85° C. and humidity 50% RH to temperature 85° C. and humidity 60% RH. FIG. 3 shows the result of the measurement. It is clear from the result shown in FIG. 3 that the external surface temperature of the section in the main body part 32 with the heat-pipe phenomenon where the liquid working fluid is accumulated, that is, the external surface temperature of the section where the working fluid evaporates detected by the external temperature sensor 57, becomes substantially equal to the wet-bulb temperature of the measurement space after a lapse of a predetermined time period since the start of the measurement, the wet-bulb temperature being measured on the temperature and humidity chamber side. Therefore, by using the external temperature sensor 57 to detect the external surface temperature of the section where the working fluid is accumulated, the section being in the front side part 32*a* within the dehumidifying space S3 in the main body part 32 where the heat-pipe phenomenon is caused, the wet-bulb temperature of the dehumidifying space S3 could be derived.

As shown in FIG. 1, the temperature control unit 8 is installed on the downstream side of the dehumidifying part 6 in the circulation space S2 and in the vicinity of the feed port 2*e* feeding the air to the temperature and humidity control space S1. This temperature control unit 8 is for controlling the temperature of the air dehumidified by the dehumidifying part 6, by heating or cooling this air so that the temperature of the air becomes close to a set temperature. Note that the temperature control unit 8 heats or cools this air such that the absolute humidity of the air does not change. A temperature sensor 59 is installed in the temperature and humidity control space S1, and the temperature control unit 8 controls the temperature of the air in accordance with the temperature of the temperature and humidity control space S1 that is detected by the temperature sensor 59.

The blower part 10 is installed parallel to the temperature control unit 8. The blower part 10 has a fan, not shown, and sends the temperature-controlled air controlled by the temperature control unit 8 into the temperature and humidity control space S1 through the feed port 2*e* by driving the fan.

The setting part 12 is used by a user to set a set value Hsv of the relative humidity of the temperature and humidity control space S1 and a set value of the temperature of the same.

The controller 14 functions to drive and control the dehumidifying part 6, the temperature control unit 8, and the blower part 10. The controller 14 has an input part 62, a computing unit 64, a dehumidification control unit 66, and a temperature control and blow control unit 68.

The signal indicating the result of the detection performed by the external surface temperature sensor 57 of the dehumidifying part 6, the signal indicating the result of the detection performed by the air temperature sensor 55, and the signal indicating the result of the detection performed by the temperature sensor 59 provided in the temperature and humidity control space S1 are input to the input part 62. Out of these input signals, the input part 62 outputs the signal from the external surface temperature sensor 57 and the signal from the air temperature sensor 55 to the computing unit 64, and further outputs the signal from the temperature sensor 59 provided in the temperature and humidity control space S1 to the temperature control and blow control unit 68.

The computing unit 64 calculates the humidity of the air fed to the dehumidifying space S3 of the dehumidifying part 6, based on the signals input from the input part 62. Specifically, the computing unit 64 calculate the relative humidity Hpv of the air fed to the dehumidifying space S3, based on the external surface temperature of the front side part 32*a* of the main body part 32 detected by the external surface temperature sensor 57, that is, the wet-bulb temperature of the dehumidifying space S3, and based on the air temperature Tpv detected by the air temperature sensor 55. Further, the computing unit 64 calculates an absolute humidity (detection value) ABHpv of the air around the front side part 32*a* in the dehumidifying space S3, based on the air temperature Tpv detected by the air temperature sensor 55 and the calculated relative humidity Hpv described above. In addition, the computing unit 64 calculates an absolute humidity ABHpv of the air around the front side part 32*a*, which becomes a target value, on the basis of the air temperature Tpv detected by the air temperature sensor 55 and the set value Hsv of the relative humidity that is set by the setting part 12.

The results of the calculation performed by the computing unit 64 are input to the dehumidification control unit 66. The dehumidification control unit 66 is configured by a microcomputer and executes a recorded control program. The dehumidification control unit 66 not only compares the calculated absolute humidity (detection value) ABHpv of the air around the front side part 32*a* with the calculated absolute humidity ABHsv of the air around the front side part 32*a*, which becomes the target value, but also determines whether or not the detection value ABHpv is higher than the target value ABHsv. The dehumidification control unit 66 then controls the drive of the dehumidifying part 6, that is, the drive of the fans 44, 49 and the pettier element 34, based on the result of the determination.

The signal indicating the result of the detection performed by the temperature sensor 59 provided in the temperature and humidity control space S1, that is, the signal representing the temperature of the temperature and humidity control space S1, is input from the input part 62 to the temperature control and blow control unit 68. The temperature control and blow control unit 68 controls the temperature control unit 8 based on this input signal and the set value of the temperature that is set by the setting part 12. Specifically, the temperature control and blow control unit 68 controls the degree of heating or cooling of the air performed by the temperature control unit 8, so that the temperature of the temperature and humidity control space S1 becomes close to the abovementioned temperature set value. At this moment, the temperature control unit 8 heats or cools the air without changing the absolute humidity of the air. The temperature control and blow control unit 68 also controls the drive of the blower part 10.

Next, the following describes the operation for controlling the temperature and humidity of the temperature and humidity control space S1 in the temperature and humidity control apparatus according to the first embodiment.

First, the air discharged from the temperature and humidity control space S1 is humidified to a predetermined humidity by the humidifying part 4. The humidified air is sent to the dehumidifying part 6 via the circulation space S2. The dehumidifying part 6 dehumidifies the air to the set humidity and sends the dehumidified air to the temperature control unit 8. The temperature control unit 8 controls the temperature of the air to the set temperature, and this air is sent to the temperature and humidity control space S1 via the feed port 2*e* by the blower part 10. In this manner, the air repeatedly circulates through the temperature and humidity control space S1 and the circulation space S2.

Figure 4:
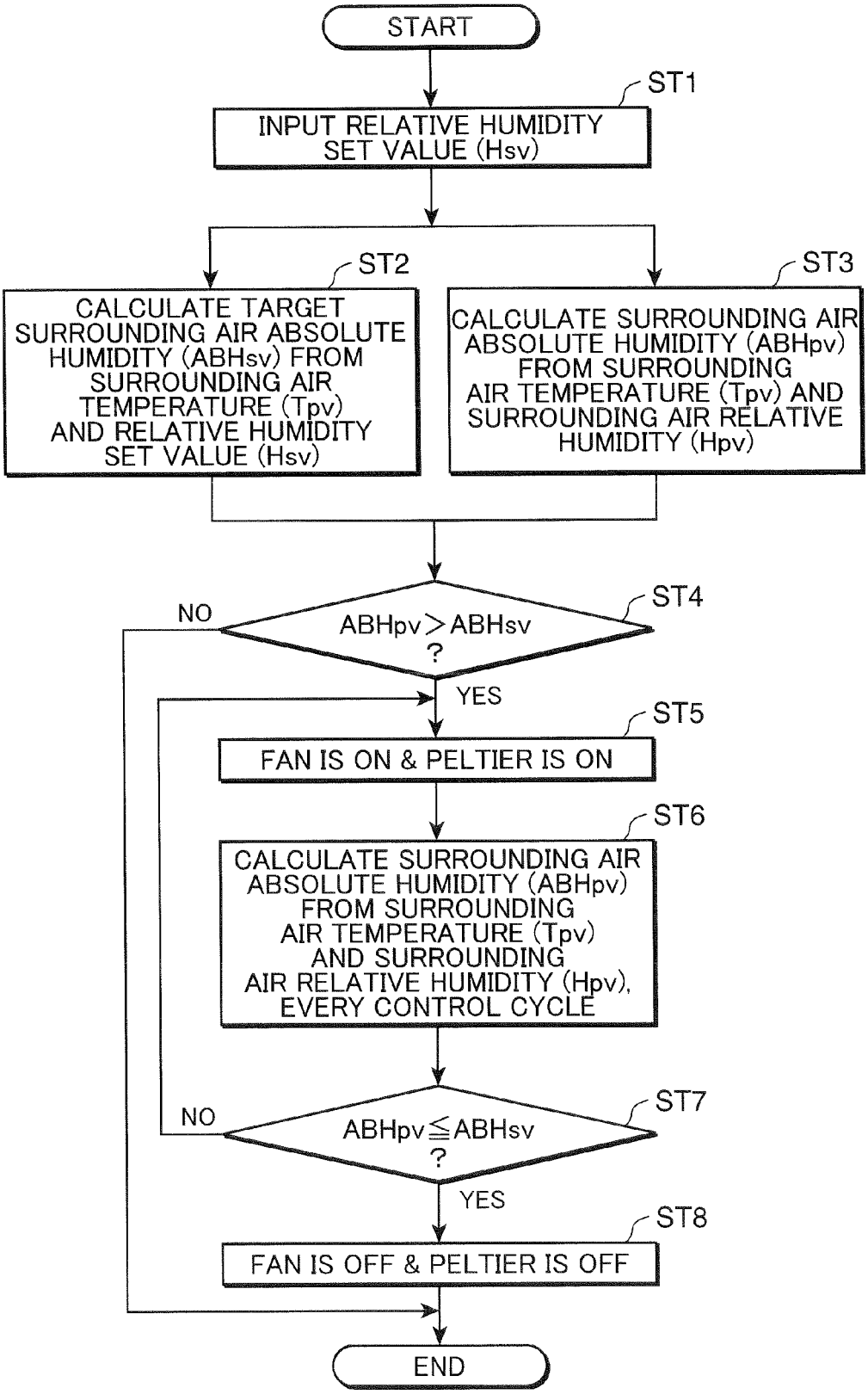
FIG. 4 is a flowchart for explaining a control operation performed by the dehumidifying part of the temperature and humidity control apparatus according to the first embodiment of the present invention.

As shown in FIG. 4, when the user inputs the set value Hsv of the relative humidity by means of the setting part 12 while the circulation of the air is carried out as described above, the set value Hsv is input from the setting part 12 to the controller 14 (step ST1). Consequently, the computing unit 64 calculates the absolute humidity ABHsv of the air around the front side part 32*a*, which becomes the target value of the dehumidification performed by the dehumidifying part 6, as well as the absolute humidity (detection value) ABHpv of the air around the front side part 32*a* in the dehumidifying space S3 (steps ST2 and ST3). At this moment, the computing unit 64 calculates the relative humidity Hpv of the air, based on the external surface temperature of the front side part 32*a* of the main body part 32 detected by the external surface temperature sensor 57, that is, the wet-bulb temperature of the dehumidifying space S3, and based on the air temperature Tpv detected by the air temperature sensor 55, and further calculates the absolute humidity (detection value) ABHpv, based on this calculated relative humidity Hpv.

Thereafter, the dehumidification control unit 66 compares the detection value ABHpv with the target value ABHsv, and determines whether or not the detection value ABHpv is higher than the target value ABHsv (step ST4).

When the dehumidification control unit 66 determines that the detection value ABHpv is greater than the target value ABHsv, the dehumidification control unit 66 drives the fans 44, 49 and the peltier element 34 (step ST5). A predetermined flow volume of the air flowing from the humidifying part 4 is fed into the dehumidifying space S3 via the intake port 22*c* by driving the fan 44. On the other hand, the air except for the predetermined flow-volume air flows toward the downstream side via the bypass 7. At this moment, the flow volume of the air fed into the dehumidifying space S3 is controlled by controlling the rotation speed of the fan 44. Some of the moisture contained in the air fed into the dehumidifying space S3 adheres to the front side part 32*a* of the main body part 32 and condenses. Then, the working fluid within the front side part 32*a* evaporates as the moisture condenses on the surface of the front side part 32*a*, and thus obtained gaseous working fluid flows toward the base side part 32*b* at substantially sonic speed. In the base side part 32*b* of the main body part 32, on the other hand, the gaseous working fluid is condensed by the heat absorption operation of the heat absorption part 34*a* of the peltier element 34, and thus obtained liquid working fluid flows toward the front side part 32*a*. In this manner, with the repetition of the evaporation and condensation of the working fluid in a predetermined place, the heat is transmitted as the working fluid transits from the section where it evaporates to the section where it is condensed in the main body part 32.

Because the temperature of the heat release part 34*b* of the peltier element 34 is increased by driving the peltier element 34, the heat of the heat release part 34*b* is released to the heat release space S4 via the heatsink 36. Then, the air the temperature of which is increased in the heat release space S4 is discharged through the upper opening 46 by the drive of the fan 49.

While the fans 44, 49 and the peltier element 34 are driven, the computing unit 64 computes the absolute humidity (detection value) ABHpv of the surrounding air on a predetermined cycle (step ST6), and the dehumidification control unit 66 compares the detection value ABHpv with the target value ABHsv (step ST7). When the detection value ABHpv is greater than the target value ABHsv, the dehumidification control unit 66 drives the fans 44, 49 and the peltier element 34 continuously, and then stops the fans 44, 49 and the peltier element 34 when the detection value ABHpv becomes equal to or lower than the target value ABHsv (step ST8). Through the operation described above, the humidity of the air of the dehumidifying space S3 is controlled to the set humidity.

The temperature of the air dehumidified to the set humidity by the dehumidifying part 6 is controlled to the set temperature by the temperature control unit 8. At this moment, the temperature control unit 8, controlled by the temperature control and blow control unit 68, heats the air when the temperature of the temperature and humidity control space S1 that is detected by the temperature sensor 59 is lower than the set temperature. The temperature control unit 8 cools the air when the temperature of the temperature and humidity control space S1 that is detected by the temperature sensor 59 is higher than the set temperature. Note that the temperature control unit 8 heats or cools the air without changing the absolute humidity of the air.

Through the series of steps described above, the humidity and the temperature of the temperature and humidity control space S1 are controlled to the set humidity and the set temperature.

As described above, in the temperature and humidity control apparatus according to the first embodiment, when the moisture contained in the air comes into contact with the front side part 32*a* of the main body part 32 in the dehumidifying part 6, the moisture contacting the front side part 32*a* is condensed. As a result, the air is dehumidified. In the main body part 32, on the other hand, the working fluid within the front side part 32*a* evaporates due to the condensation of the moisture, becomes a gas, and then moves through the main body part 32 to the base side part 32*b* at substantially sonic speed. In the base side part 32*b*, the latent heat of the working fluid is removed by the heat absorption part 34*a* of the peltier element 34, whereby the working fluid is condensed. Evaporation and condensation of the working fluid is repeated in the main body part 32 in this manner. At this moment, because the heat-insulating part 24 blocks the heat transmission from the air flowing around the front side part 32*a* of the main body part 32 to the base side part 32*b*, the difference in temperature between the front side part 32*a* and the base side part 32*b* in the main body part 32 is kept at a predetermined temperature or higher. Therefore, the occurrence of evaporation and condensation of the working fluid within the main body part 32 can be maintained. Because the moisture contained in the air goes through a phase change and eliminated by the occurrence of the heat-pipe phenomenon in the main body part 32 of the dehumidifying part 6, the ratio of the sensible heat load to the latent heat load decreases, and the dehumidifying efficiency increases. Moreover, the heat absorption part 34*a* of the peltier element 34 simply absorbs the heat of the base side part 32*b* of the main body part 32, and the power for driving the dehumidifying part 6 becomes low. Thus, in the temperature and humidity control apparatus of the first embodiment to which such dehumidifying part 6 is applied, the dehumidifying efficiency of the dehumidifying part 6 can be improved while reducing the driving power.

Furthermore, in the dehumidifying part 6 of the temperature and humidity control apparatus according to the first embodiment, the heat-insulating part 24 separates the dehumidifying space S3 around the front side part 32*a* of the main body part 32 where the heat-pipe phenomenon is caused, from the heat release space S4 around the base side part 32*b*, and the temperature of the base side part 32*b* is lower than that of the front side part 32*a*. For this reason, external surface temperature of the section in the front side part 32*a* where the working fluid evaporates becomes substantially equal to the wet-bulb temperature of the dehumidifying space S3. Because the external surface temperature sensor 57 detects the external surface temperature of this section where the working fluid evaporates, the computing unit 64 can calculate the humidity of the air fed to the dehumidifying space S3, based on the derived external surface temperature of the section where the working fluid evaporates, and based on the temperature of the air fed from the humidifying part 4 to the dehumidifying space S3, the temperature of the air being detected by the air temperature sensor 55. Accordingly, based on the calculated humidity, the dehumidification control unit 66 of the controller 14 can control the peltier element 34 to control an air dehumidification operation performed by the front side part 32*a* using the heat-pipe phenomenon cased in the main body part 32. Therefore, in the temperature and humidity control apparatus according to the first embodiment, unlike a conventional temperature and humidity control apparatus that measures the humidity of the air using a wet and dry bulb hygrometer and at the same time performs the humidity control based on the measured humidity, a wick is not required for measuring the humidity, and hence it is not necessary to carry out the troublesome work for replacing the wick every time when the wick becomes old and the force for pumping up the water is weakened. Therefore, the workload of maintaining the control apparatus can be alleviated. Further, in the first embodiment, because the main body part 32 of the dehumidifying part 6 has both the function of detecting the wet-bulb temperature of the dehumidifying space S3 and the dehumidification function, the number of components can be reduced more than a temperature and humidity control apparatus that is provided separately with a sensor for detecting the wet-bulb temperature or the humidity and a dehumidifying mechanism.

Also, in the temperature and humidity control apparatus according to the first embodiment, because the external surface temperature sensor 57 detects the external surface temperature of the section where the liquid working fluid is accumulated when the heat-pipe phenomenon is completely caused in the main body part 32, the external surface temperature sensor 57 can directly detect the external surface temperature of the section in the main body part 32 that indicates the temperature substantially equal to the wet-bulb temperature of the air fed to the dehumidifying space S3. Consequently, because the wet-bulb temperature of the air fed into the dehumidifying space S3 can be obtained, without performing a correction, from the external surface temperature detected by the external surface temperature sensor 57, the humidity of the fed air can be obtained with a higher degree of accuracy.

Second Embodiment

Figure 5:
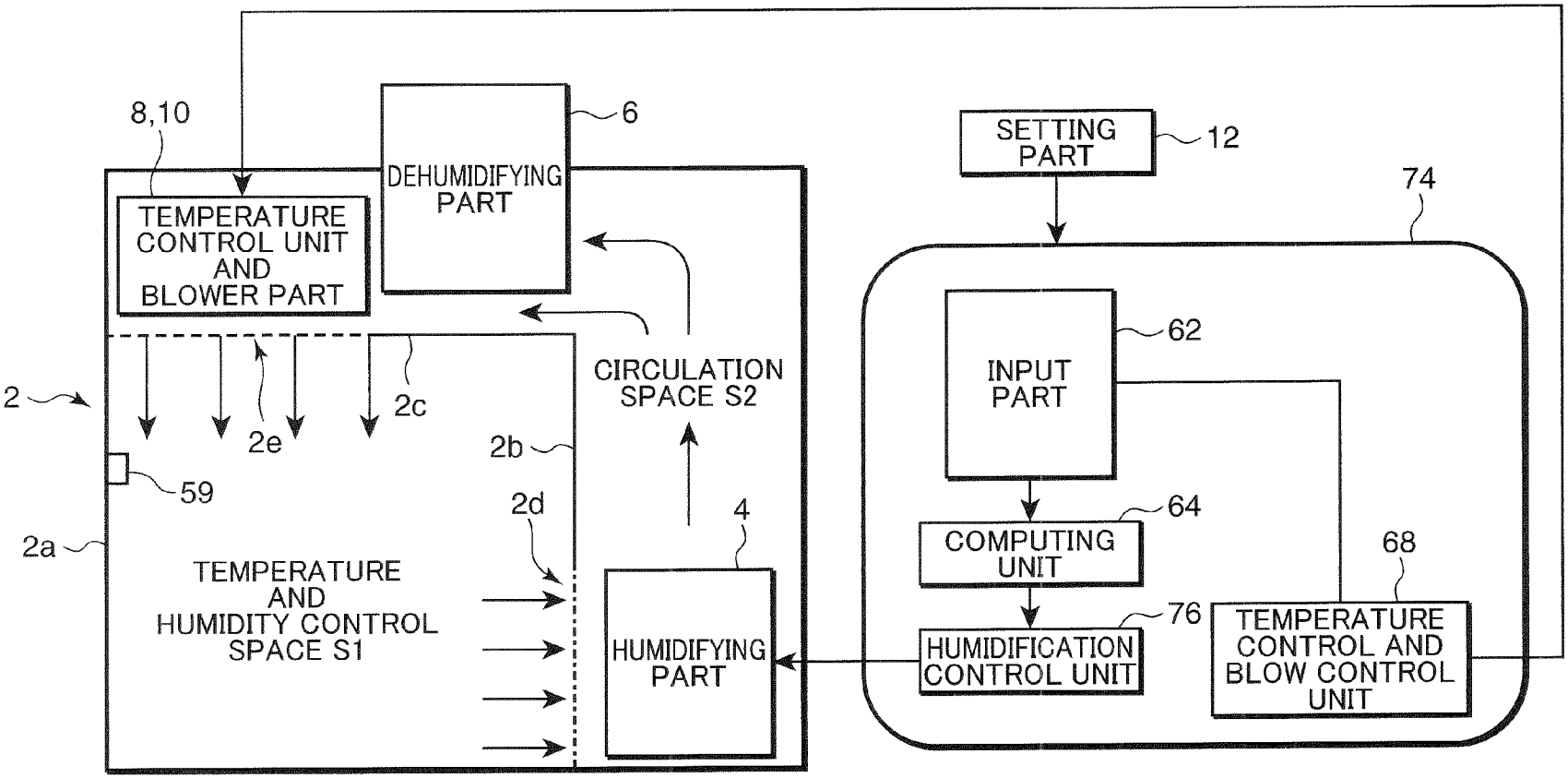
FIG. 5 is a block diagram schematically showing a configuration of a temperature and humidity control apparatus according to a second embodiment of the present invention.

Next, a configuration of the temperature and humidity control apparatus according to a second embodiment of the present invention is described with reference to FIG. 5.

Unlike the first embodiment, in the second embodiment the humidity of the temperature and humidity control space S1 is controlled by controlling the humidification capacity of the humidifying part 4.

Specifically, controller 74 according to the second embodiment controls the operation of the humidifying part 4. This controller 74 has the input part 62, the computing unit 64, a humidification control unit 76, and the temperature control and blow control unit 68.

The humidifying part 4 has an unshown water storage tank with water accumulated therein, and an unshown heater for heating the water in the water storage tank, wherein the heater heats and evaporates the water in the water storage tank to humidify the air.

The humidification control unit 76 controls the humidification capacity of the humidifying part 4. In other words, the humidification control unit 76 controls the humidification capacity of the humidifying part 4 by performing ON/OFF control on the heater of the humidifying part 4. Specifically, when the humidification control unit 76 turns the heater on, evaporation of the water within the water storage tank is promoted, and thereby humidification of the air is promoted by the humidifying part 4. On the other hand, when the humidification control unit 76 turns the heater off, the water within the water storage tank is prevented from evaporating, and the air is also prevented from being humidified by the humidifying part 4.

The dehumidifying part 6 has the same configuration as that of the first embodiment. Humidity deriving part for deriving the humidity of the air humidified by the humidifying part 4 and then fed into the dehumidifying part 6 is configured by the main body part 32 of this dehumidifying part 6, the air temperature sensor 55, the external surface temperature sensor 57, and the input part 62 and computing unit 64 of the controller 74.

Unlike the temperature and humidity control apparatus of the first embodiment in which the fans 44, 49 of the dehumidifying part 6 and the peltier element 34 are switched ON/OFF, in the temperature and humidity control apparatus according to the second embodiment the fans 44, 49 of the dehumidifying part 6 and the peltier element 34 are driven in a constant drive state. In the second embodiment, in the dehumidifying part 6 the same humidity detection as that of the first embodiment is carried out using the main body part 32 where the heat-pipe phenomenon is caused. Also, air dehumidification is performed with the humidity detection.

The rest of the configuration of the temperature and humidity control apparatus according to the second embodiment is same as the configuration of the temperature and humidity control apparatus according to the first embodiment.

Next, the following describes the operation for controlling the temperature and humidity of the temperature and humidity control space S1 in the temperature and humidity control apparatus according to the second embodiment.

As with the first embodiment, in the temperature and humidity control apparatus according to the second embodiment, the air is humidified by the humidifying part 4 while repeatedly circulating between the temperature and humidity control space S1 and the circulation space S2, the air is then dehumidified by the dehumidifying part 6, and the temperature of the air is controlled to the set temperature by the temperature control unit 8. At this moment, in the dehumidifying part 6, the heat-pipe phenomenon is completely caused in the main body part 32. Thus, the dehumidifying part 6 exerts a constant dehumidification capacity.

Figure 6:
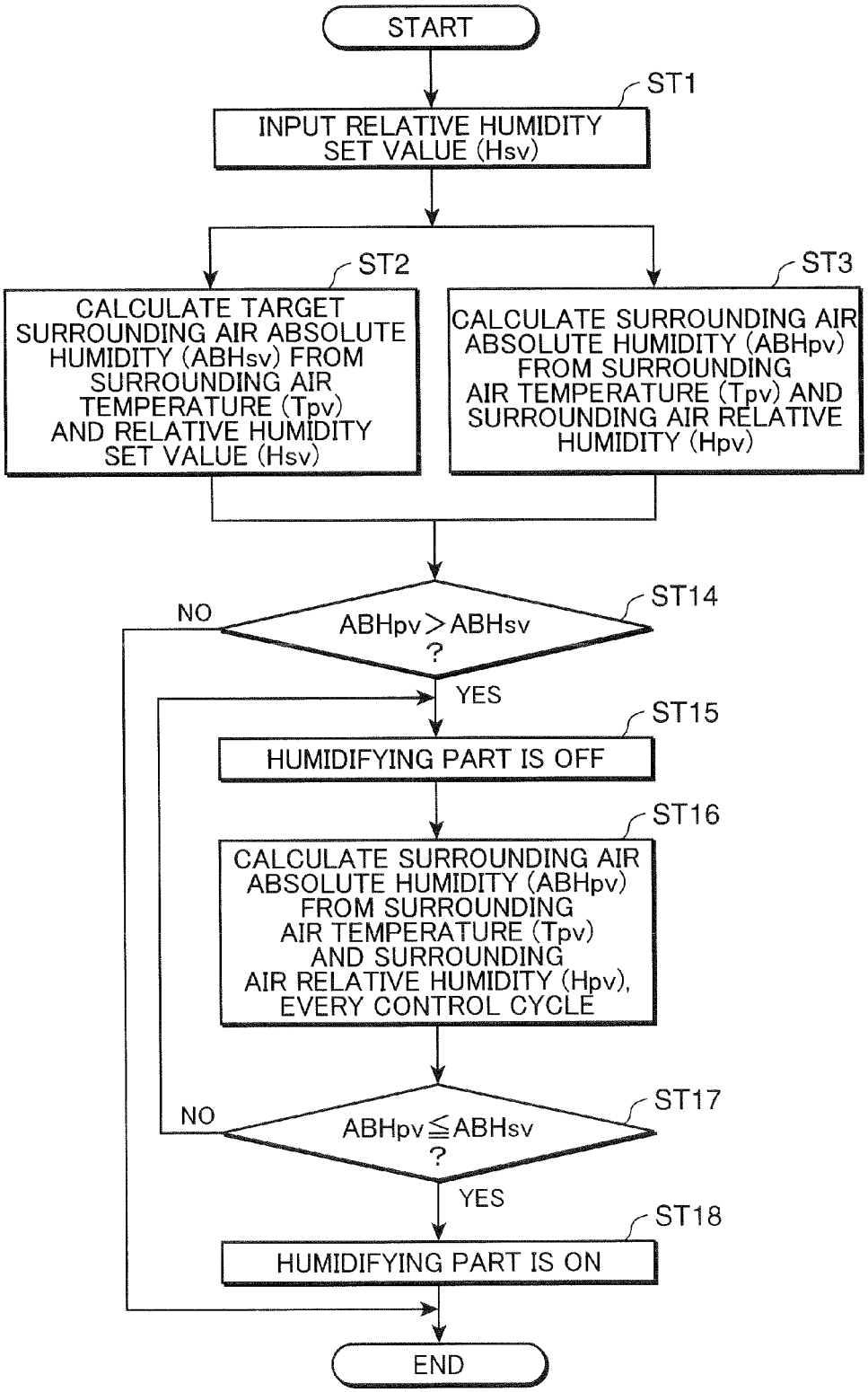
FIG. 6 is a flowchart for explaining a control operation performed by a dehumidifying part of the temperature and humidity control apparatus according to the second embodiment of the present invention.

In the second embodiment as well, the steps ST1 to ST3 shown in FIG. 6, that is, input of the relative humidity set value Hsv, calculation of the target value ABHsv of the absolute humidity of the surrounding air, and calculation of the detection value ABHpv of the absolute humidity of the surrounding air, are performed in the same manner as the first embodiment.

Thereafter, the humidification control unit 76 compares the detection value ABHpv with the target value ABHsv and determines whether or not the detection value ABHpv is higher than the target value ABHsv (step ST14).

When the humidification control unit 76 determines that the detection value ABHpv is higher than the target value ABHsv, the operation of the humidifying part 4 is stopped (step ST15). Specifically, at this moment the humidification control unit 76 turns off the heater of the humidifying part 4. Consequently, the water within the water storage tank is prevented from evaporating, and the air is prevented from being humidified by the humidifying part 4. As a result, the humidity of the air fed from the humidifying part 4 into the temperature and humidity control space S1 via the circulation space S2, the dehumidifying part 6, the temperature control unit 8 and the blower part 10 is reduced.

While the temperature and humidity control apparatus is activated, the computing unit 64 computes the detection value ABHpv on a predetermined cycle (step ST16), and the humidification control unit 76 compares the detection value ABHpv with the target value ABHsv (step ST17). At this moment, when the detection value ABHpv is higher than the target value ABHsv, the humidification control unit 76 continuously stops the activation of the humidifying part 4, and then starts the activation of the humidifying part 4 when the detection value ABHpv becomes equal to or lower than the target value ABHsv (step ST18). Specifically, the humidification control unit 76 promotes the evaporation of the water within the water storage tank and promotes the humidification of the air performed by the humidifying part 4, by turning on the heater of the humidifying part 4. As a result, the humidity of the air fed from the humidifying part 4 into the temperature and humidity control space S1 via the circulation space S2, the dehumidifying part 6, the temperature control unit 8 and the blower part 10 is increased. The humidity of the temperature and humidity control space S1 is controlled to the set humidity by this operation of the humidifying part 4.

The rest of the operation of the temperature and humidity control apparatus according to the second embodiment is same as the operation of the temperature and humidity control apparatus according to the first embodiment.

As described above, in the second embodiment, the humidification control unit 76 can control the humidification capacity of the humidifying part 4 and control the humidity of the air fed into the temperature and humidity control space S1, based on the detection value ABHpv and the target value ABHpv that are calculated by the computing unit 64. Therefore, the humidity of the temperature and humidity control space S1 can be controlled without controlling the dehumidification capacity of the dehumidifying part 6.

Note that the embodiments disclosed herein are merely examples in all respects and should not be considered restrictive. The scope of the present invention is defined by the scope of claims rather than by the above description of the embodiments, and includes meanings equivalent to those of the scope of claims and any modification within the scope of claims.

For example, in the embodiments described above, although the external surface temperature sensor 57 detects the external surface temperature of the section in the vicinity of the end part of the front side part 32*a* of the main body part 32 where the working fluid evaporates, the present invention is not limited to this configuration. Specifically, the external surface temperature sensor 57 may be attached to the external surface of the other predetermined section of the main body part 32 to detect the external surface temperature of this section. In this case, the temperature difference is generated between the temperature detected by the external surface temperature sensor 57 and the external surface temperature of the section where the working fluid evaporates, i.e., the wet-bulb temperature of the dehumidifying space S3. Thus, correction part is provided in addition to the external surface temperature sensor 57, and the temperature difference is measured beforehand, so that the wet-bulb temperature of the dehumidifying space S3 can be obtained by causing the correction part to correct the detected temperature of the external surface temperature sensor 57 by the temperature difference. In this case, for example, the external surface temperature sensor 57 may be attached to the base side part 32*b* of the main body part 32 of the configurations of the embodiments described above. In this aspect, the main body temperature deriving part of the present invention is configured by the external surface temperature sensor 57 and the correction part.

In the embodiments described above, although the external surface temperature sensor 57 is attached directly to the external surface of the main body part 32 to detect the external surface temperature, a temperature sensor for detecting the external surface temperature of the main body part 32 in a non-contact state may be used as the external surface temperature sensor 57.

Moreover, in the embodiments described above, the external surface temperature sensor 57 is attached to the external surface of the section in the front side part 32*a* of the main body part 32 where the working fluid evaporates, to detect the external surface temperature of this section. However, an internal surface temperature sensor functioning as the main body temperature deriving part of the present invention may be attached to an internal surface of the section in the main body part 32 where the working fluid evaporates, to detect the internal surface temperature of this section and calculate the humidity of the dehumidifying space S3 based on this internal surface temperature. Because the internal surface temperature of the section in the main body part 32 where the working fluid evaporates is considered to represent the wet-bulb temperature of the dehumidifying space S3 more accurately rather than the external surface temperature of this section, the humidity of the dehumidifying space S3 can be obtained more accurately in this case. Further, as with the case in which the external surface temperature sensor 57 is attached to the external surface of the main body part 32 as described above, when attaching the internal surface temperature sensor to the internal surface of the main body part 32, the internal surface temperature sensor may be attached to the internal surface of a predetermined section other than the section in the main body part 32 where the working fluid evaporates. In this case, however, as with the case described above, it is necessary to provide the correction part for correcting the temperature difference between the detected temperature by the internal surface temperature sensor and the internal surface temperature of the section where the working fluid evaporates. In other words, in this aspect, the main body temperature deriving part of the present invention is configured by the internal surface temperature sensor and the correction part.

In the embodiments described above, by absorbing the heat from the base side part 32*b* of the main body part 32 by means of the heat absorption part 34*a* of the peltier element 34, the heat-pipe phenomenon is caused by condensing, in the base side part 32*b*, the working fluid that evaporated in the front side part 32*a* of the main body part 32 into gas. However, the present invention is not restricted to this configuration. Specifically, the air of the dehumidifying space S3 may be dehumidified by the front side part 32*a* of the main body part 32 where the heat-pipe phenomenon is caused, without providing the peltier element 34 in the dehumidifying part 6.

For example, the peltier element 34, the heatsink 36, the connection part 38, and the fan 49 are omitted from the configuration of the dehumidifying part 6 of the embodiments described above. Also, the temperature of the heat release space S4 is lower than that of the dehumidifying space S3. Note that the heat release space S4 falls into the concept of the external space according to the present invention. The main body part 32 is disposed across the dehumidifying space S3 and the heat release space S4 that are spaced from each other by the heat-insulating part 24, and the temperature of the heat release space S4 is lower than that of the dehumidifying space S3, so that the liquid working fluid evaporates in the front side part 32*a* of the main body part 32 disposed in the dehumidifying space S3, and the evaporated working fluid is condensed in the base side part 32*b* disposed in the heat release space S4. Specifically, the heat-pipe phenomenon is caused in the main body part 32, and, as with the embodiments described above, the air of the dehumidifying space S3 is dehumidified by the front side part 32*a* of the main body part 32 disposed in the dehumidifying space S3. Note that the front side part 32*a* of the main body part 32 falls into the concept of the one side part according to the present invention.

As with the embodiments described above, in this configuration as well, because the moisture contained in the air goes through a phase change and is removed due to the heat-pipe phenomenon caused in the main body part 32 of the dehumidifying part 6, the ratio of the sensible heat load to the latent heat load decreases, and the dehumidifying efficiency increases. In addition, dehumidification can be performed by the main body part 32 only, without requiring the power for driving the dehumidifying part 6. Therefore, in this configuration as well, the effect of improving the dehumidifying efficiency of the dehumidifying part 6 while reducing the driving power can be achieved as in the embodiments described above.

Various cooling means other than the peltier element may be used as the heat absorption part to cool the base side part 32*b* of the main body part 32 and condense the gaseous working fluid in the base side part 32*b*.

Although the main body part 32 is configured by a heat pipe in the embodiments described above, the main body part 32 may be configured by a meandering capillary tube heat pipe or an oscillating heat pipe known as a Heat Lane™.

The above embodiments have described an example in which the present invention is applied to the temperature and humidity control apparatus, the present invention is not limited to this configuration. For example, the present invention may be applied similarly to a humidity control apparatus that controls the absolute humidity only. This humidity control apparatus can be configured by omitting the temperature control unit 8 and the temperature sensor 59 from the temperature and humidity control apparatus of the above embodiments and by omitting the control function on the temperature control unit 8 from the temperature control and blow control unit 68. In addition, the present invention can be similarly applied to the environment test apparatus. According to this environment test apparatus, in the temperature and humidity control apparatus of the embodiments described above, the controller 14 is provided with a humidification control unit, and the humidification capacity of the humidifying part 4 is controlled by this humidification control unit. Controlling the humidification capacity of the humidifying part 4 by means of the humidification control unit is performed in the same manner as the control of the humidification capacity of the humidifying part 4 that is performed by the humidification control unit 76 of the second embodiment, and the humidification capacity of the humidifying part 4 is controlled such that the humidity of the air humidified by the humidifying part 4 becomes close to the set humidity. In these humidity control apparatus and environment test apparatus as well, the effect of improving the dehumidifying efficiency of the dehumidifying part while reducing the driving power can be achieved as in the temperature and humidity control apparatus of the embodiments described above.

In the embodiments described above, although the humidifying part 6 is installed on the upstream side of the temperature control unit 8 in the circulation space S2, the present invention is not restricted to this configuration. Specifically, the dehumidifying part 6 may be installed on the downstream side of the temperature control unit 8.

In the embodiments described above, although the heat-insulating part 24 of the dehumidifying part 6 is configured by using a part of the outer wall 2*a* of the housing 2, the present invention is not restricted to this configuration. For example, the dehumidifying part internal housing 22*a* and the dehumidifying part external housing 22*b* may be incorporate in the housing 2 of the control apparatus, and the heat-insulating part 24 may be formed separately from the outer wall 2*a* of the housing 2. In this case, by integrally configuring the heat-insulating part 24 and the dehumidifying part external housing 22*b* by using a heat-insulating material, the heat release space S4 may be separated from the dehumidifying space S3 and the circulation space S2 by the heat-insulating material.

Figure 7:
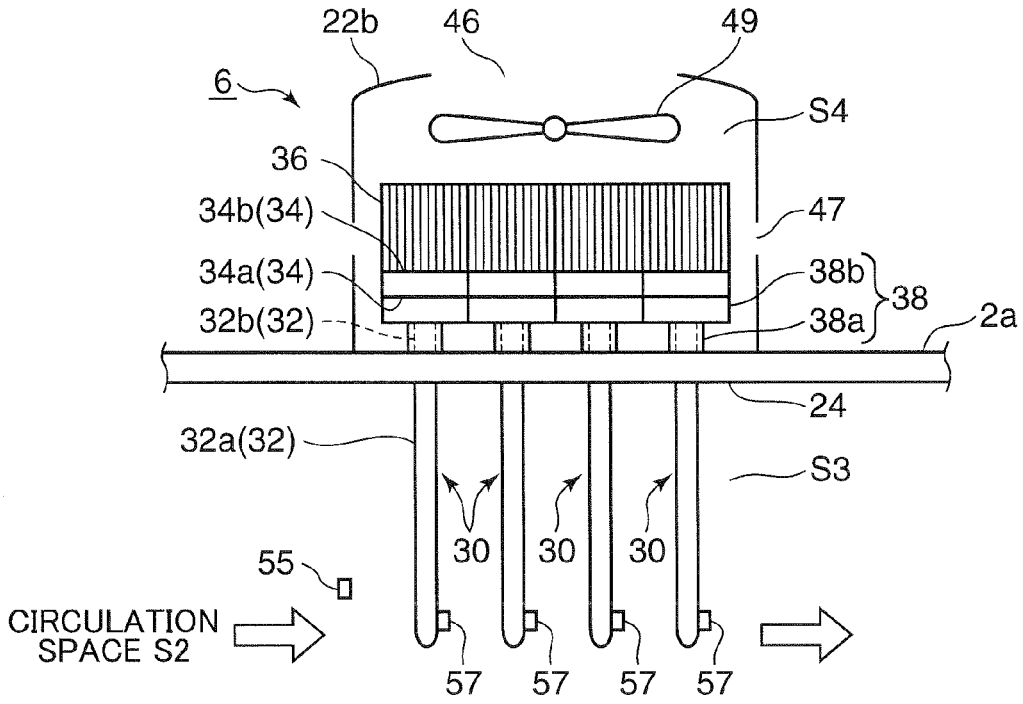
FIG. 7 is a diagram schematically showing a structure of the dehumidifying part according to a modification of the embodiments of the present invention.

As in the modification of the embodiments shown in FIG. 7, the fan 44, dehumidifying part internal housing 22*a* and recovery part 50 of the embodiments may be omitted. In this case, in the dehumidifying part 6, the airflow through the dehumidifying space S3 around the front side part 32*a* of the main body part 32 is created by the fan of the blower part 10, which is not shown. Therefore, in this modification, the fan of the blower part 10 is driven in step ST5, instead of the fan 44. Further, the drive of the fan of the blower part 10 is stopped in step ST8, instead of the fan 44.

In the dehumidifying part 6, the heat absorption operation of the heat absorption part 34*a* of the peltier element can be controlled so that a predetermined temperature difference is obtained between the front side part 32*a* and the base side part 32*b* of the main body part 32, whereby the external surface temperature of the section in the front side part 32*a* where the external surface temperature sensor 57 is attached can be kept at the temperature equal to the dew-point temperature of the dehumidifying space S3. Note that the predetermined temperature difference varies according to the configuration of the heat pipe of the main body part 32. In this case, the temperature that is equal to the dew-point temperature of the dehumidifying space S3 is input as the detected temperature, from the external surface temperature sensor 57 to the input part 62. In this case, the computing unit 64 may calculate the relative humidity Hpv of the air on the basis of the detected temperature equal to the dew-point temperature and the air temperature Tpv detected by the air temperature sensor 55, and calculate the absolute humidity (detection value) ABHpv on the basis of the calculated relative humidity Hpv.

The temperature and humidity control space S1 may be cooled by means of the heat released from the temperature and humidity control space S1. The temperature and humidity control space S1 may be heated by using the heat generated by driving the fan of the blower part 10.

In the second embodiment, the fan 44 of the dehumidifying part 6 and the bypass 7 may be omitted.

SUMMARY OF THE EMBODIMENTS

The summary of the embodiments is described hereinafter.

Specifically, the humidity control apparatus according to the embodiments is a humidity control apparatus having a humidifying part for humidifying air and a dehumidifying part for dehumidifying air, and for controlling a humidity of a humidity control space by means of the humidifying part and the dehumidifying part, wherein the dehumidifying part has a main body part that is configured to encapsulate a working fluid therein and to cause a heat-pipe phenomenon, a heat-insulating part fitted externally to the main body part, and a heat absorption part that absorbs heat from a base side part located on one side of the main body part in relation to the heat-insulating part and thereby condenses the working fluid that evaporated into gas in a front side part located on the other side of the main body part in relation to the heat-insulating part, and wherein the dehumidifying part dehumidifies the air by means of condensation of moisture on a surface of the front side part of the main body part where the working fluid in liquid form evaporates therein.

In this humidity control apparatus, the humidifying part humidifies the air and the dehumidifying part dehumidifies the air, whereby the humidity of the air is controlled. In the dehumidifying part, when the moisture contained in the air comes into contact with the front side part of the main body part, the moisture contacting the front side part condenses. As a result, the air is dehumidified. In the main body part, on the other hand, the working fluid within the front side part evaporates into gas as the moisture condenses, and moves through the main body part to the base side part at substantially sonic speed. In the base side part, the latent heat of the working fluid is removed by the heat absorption part, whereby the working fluid is condensed. Evaporation and condensation of the working fluid is repeated in the main body part in this manner. At this moment, because the heat-insulating part blocks the heat transmission from the air flowing around the front side part of the main body part to the base side part, the difference in temperature between the front side part and the base side part in the main body part is kept at a predetermined temperature or higher. Therefore, the occurrence of evaporation and condensation of the working fluid within the main body part can be maintained. Because the moisture contained in the air goes through a phase change and eliminated by the occurrence of the heat-pipe phenomenon in the main body part of the dehumidifying part, the ratio of the sensible heat load to the latent heat load decreases, and the dehumidifying efficiency increases. Moreover, the heat absorption part simply absorbs the heat of the base side part of the main body part, and the power for driving the dehumidifying part becomes low. Thus, in the humidity control apparatus to which such dehumidifying part is applied, the dehumidifying efficiency of the dehumidifying part can be improved while reducing the driving power.

It is preferred in the humidity control apparatus that the heat absorption part is configured by a heat absorption part of a peltier element.

It is preferred that the humidity control apparatus further has controller for controlling drive of the dehumidifying part, that the dehumidifying part has an air temperature detecting unit for detecting a temperature of air fed to the dehumidifying part, and main body temperature deriving part for deriving a temperature of the main body part in a section where the working fluid evaporates, and that the controller has a computing unit for calculating a humidity of the air fed to the dehumidifying part based on the temperature of the air detected by the air temperature detecting unit and the temperature of the main body part derived by the main body temperature deriving part, and a dehumidification control unit for controlling the heat absorption part based on the humidity calculated by the computing unit.

As a result of the keen investigation, the inventor of the present application has discovered that, by disposing the main body part where the heat-pipe phenomenon is caused across the two spaces spaced from each other by the heat-insulating part, and by making the temperature of the end part of the main body part located in one of the spaces lower than the temperature of the end part of the main body part located in the other space, the temperature of the section of the main body part in the other space where the working fluid evaporates becomes substantially equal to the wet-bulb temperature or the dew-point temperature of the other space. Therefore, in the configuration described above, because the space where the front side part of the main body part is located and the space where the base side part is located are spaced from each other by the heat-insulating part, and because the heat of the base side part is absorbed by the heat absorption part and thereby the base side is made cooler than the front side part, the working fluid evaporates in the front side part, and the temperature of the main body part in the section where the working fluid evaporates becomes substantially equal to the wet-bulb temperature or the dew-point temperature of the air contacting this section. Because the temperature of the main body part in the section where the working fluid evaporates is derived by the main body temperature deriving part, the computing unit can calculate the humidity of the air fed to the dehumidifying part, based on the derived temperature of the section where the working fluid evaporates and the temperature of the air detected by the air temperature detecting unit. As a result, based on the calculated humidity, the dehumidification control unit of the controller can control the heat absorption part to control the air dehumidification operation performed by the front side part using the heat-pipe phenomenon of the main body part. Therefore, according to this configuration, unlike a conventional humidity control apparatus that measures the humidity of the air using a wet and dry bulb hygrometer and at the same time performs the humidity control based on the measured humidity, a wick is not required for measuring the humidity, and hence it is not necessary to carry out the troublesome work for replacing the wick every time when the wick becomes old and the force for pumping up the water is weakened. Therefore, the workload of maintaining the control apparatus can be alleviated. In addition, according to this configuration, because the main body part of the dehumidifying part has both the function of detecting the wet-bulb temperature or the dew-point temperature and the dehumidification function, the number of components can be reduced more than a humidity control apparatus that is provided separately with a sensor for detecting the wet-bulb temperature, dew-point temperature or humidity and a dehumidifying mechanism.

It is preferred that the humidity control apparatus has controller for controlling drive of the humidifying part, that the dehumidifying part has an air temperature detecting unit for detecting a temperature of air fed to the dehumidifying part, and main body temperature deriving part for deriving a temperature of the main body part in a section where the working fluid evaporates, and that the controller has a computing unit for calculating a humidity of the air fed to the dehumidifying part based on the temperature of the air detected by the air temperature detecting unit and the temperature of the main body part derived by the main body temperature deriving part, and a humidification control unit for controlling a humidification capacity of the humidifying part based on the humidity calculated by the computing unit.

As with the configuration described above, in this configuration the space where the front side part of the main body part is located and the space where the base side part is located are spaced from each other by the heat-insulating part, and the heat of the base side part is absorbed by the heat absorption part and thereby the base side is made cooler than the front side part. Therefore, the working fluid evaporates in the front side part, and the temperature of the main body part in the section where the working fluid evaporates becomes substantially equal to the wet-bulb temperature or dew-point temperature of the air contacting this section. As a result, the computing unit can calculate the humidity of the air fed to the dehumidifying part, based on the temperature of the section in the main body part where the working fluid evaporates, the temperature being derived by the main body temperature deriving part, as well as based on the temperature of the air detected by the air temperature detecting unit. Consequently, the humidification control unit of the controller can control the humidification capacity of the humidifying part based on the calculated humidity, whereby the humidity of the humidity control space can be controlled. Therefore, unlike the conventional humidity control apparatus that measures the humidity of the air using a wet and dry bulb hygrometer and at the same time performs the humidity control based on the measured humidity, a wick is not required for measuring the humidity, and hence it is not necessary to carry out the troublesome work for replacing the wick every time when the wick becomes old and the force for pumping up the water is weakened. Therefore, the workload of maintaining the control apparatus can be alleviated.

In the configuration where the dehumidifying part has the main body temperature deriving part, it is preferred that the main body temperature deriving part derives a temperature of a section where the working fluid in liquid form is accumulated, when a heat-pipe phenomenon is completely caused in the main body part. With this configuration, the main body temperature deriving part can directly derive the temperature of the section in the main body part that indicates the temperature substantially equal to the wet-bulb temperature or dew-point temperature of the air fed to the dehumidifying part. Therefore, because the wet-bulb temperature or dew-point temperature of the air fed into the dehumidifying part can be obtained, without performing much correction, from the temperature of the main body part derived by the main body temperature deriving part, the humidity of the fed air can be obtained with a higher degree of accuracy.

In addition, the humidity control apparatus according to the embodiments described above is a humidity control apparatus having a humidifying part for humidifying air and a dehumidifying part for dehumidifying air, and for controlling a humidity of a humidity control space by means of the humidifying part and the dehumidifying part, wherein the dehumidifying part has a main body part that is configured to encapsulate a working fluid therein and to cause a heat-pipe phenomenon and disposed across a dehumidifying space for dehumidifying air to be fed to the humidity control space and an external space that is spaced from the dehumidifying space by a heat-insulating part and has a temperature lower than that of the dehumidifying space, and wherein the dehumidifying part dehumidifies air of the dehumidifying space by means of condensation of moisture on a surface of one side part of the main body part which is disposed in the dehumidifying space and where the working fluid in liquid form evaporates therein.

In this humidity control apparatus, the humidifying part humidifies the air and the dehumidifying part dehumidifies the air, whereby the humidity of the air is controlled. In the dehumidifying part, when the moisture contained in the air of the dehumidifying space comes into contact with one side part of the main body part, the moisture contacting the one side part condenses. As a result, the air is dehumidified. In the main body part, on the other hand, the working fluid within the one side part evaporates into gas as the moisture condenses, and moves through the main body part to the other side part at substantially sonic speed. Because the external space where the other side part is located is cooler than the dehumidifying space where the one side part is located, in the other side part the latent heat of the working fluid is removed, whereby the working fluid is condensed. Evaporation and condensation of the working fluid is repeated in the main body part in this manner. At this moment, because the heat-insulating part blocks the heat transmission from the dehumidifying space to the external space, the difference in temperature between the one side part and the other side part in the main body part is kept at a predetermined temperature or higher. Therefore, the occurrence of evaporation and condensation of the working fluid within the main body part can be maintained. Because the moisture contained in the air goes through a phase change and eliminated by the occurrence of the heat-pipe phenomenon in the main body part of the dehumidifying part, the ratio of the sensible heat load to the latent heat load decreases, and the dehumidifying efficiency increases. Moreover, the dehumidification is performed only by the main body part without requiring the power for driving the dehumidifying part. Thus, in the humidity control apparatus to which such dehumidifying part is applied, the dehumidifying efficiency of the dehumidifying part can be improved while reducing the driving power.

In the humidity control apparatus described above, the main body part may be configured by a heat pipe, a meandering capillary tube heat pipe, or an oscillating heat pipe.

Moreover, the environment test apparatus according to the embodiments described above is an environment test apparatus having the humidity control apparatus described above.

Because this environment test apparatus has the humidity control apparatus described above, the environment test apparatus can attain the same effect as that of the humidity control apparatus, that is, the effect of improving the dehumidifying efficiency of the dehumidifying part while reducing the driving power.

In addition, the temperature and humidity control apparatus according to the embodiments described above is a temperature and humidity control apparatus having the humidity control apparatus described above, the temperature and humidity control apparatus having a temperature control unit for controlling a temperature of the air, wherein the humidity of the humidity control space is controlled by the humidity control apparatus, and the temperature of the humidity control space is controlled by the temperature control unit.

Because the temperature and humidity control apparatus has the humidity control apparatus described above, the temperature and humidity control apparatus can attain the same effect as that of the humidity control apparatus, that is, the effect of improving the dehumidifying efficiency of the dehumidifying part while reducing the driving power.

The invention claimed is:

1. A humidity control apparatus having a humidifying part for humidifying air, a dehumidifying part for dehumidifying air and for controlling a humidity of a humidity control space by means of the humidifying part and the dehumidifying part, and a controller for controlling drive of the dehumidifying part, wherein the dehumidifying part comprises:

a main body part that is configured to encapsulate a working fluid therein and to cause a heat-pipe phenomenon;

a heat-insulating part fitted externally to the main body part; and a heat absorption part that absorbs heat from a base side part located on one side of the main body part in relation to the heat-insulating part and thereby condenses the working fluid that evaporated into gas in a front side part located on the other side of the main body part in relation to the heat-insulating part, wherein the dehumidifying part dehumidifies the air by means of condensation of moisture on a surface of the front side part of the main body part where the working fluid in liquid form evaporates therein, wherein the dehumidifying part has: an air temperature detecting unit for detecting a temperature of air fed to the dehumidifying part; and a main body temperature deriving part for deriving a temperature of the main body part in a section where the working fluid evaporates, and wherein the controller has: a computing unit for calculating a humidity of the air fed to the dehumidifying part based on the temperature of the air detected by the air temperature detecting unit and the temperature of the main body part derived by the main body temperature deriving part; and a dehumidification control unit for controlling the heat absorption part based on the humidity calculated by the computing unit.

2. The humidity control apparatus according to claim 1, wherein the heat absorption part is configured by a heat absorption part of a peltier element.

3. The humidity control apparatus according to claim 1, further comprising:

controller for controlling drive of the humidifying part, wherein the dehumidifying part has: an air temperature detecting unit for detecting a temperature of air fed to the dehumidifying part; and main body temperature deriving part for deriving a temperature of the main body part in a section where the working fluid evaporates, and wherein the controller has: a computing unit for calculating a humidity of the air fed to the dehumidifying part based on the temperature of the air detected by the air temperature detecting unit and the temperature of the main body part derived by the main body temperature deriving part; and a humidification control unit for controlling a humidification capacity of the humidifying part based on the humidity calculated by the computing unit.

4. The humidity control apparatus according to claim 1, wherein the main body temperature deriving part derives a temperature of a section where the working fluid in liquid form is accumulated, when a heat-pipe phenomenon is completely caused in the main body part.

5. The humidity control apparatus according to claim 1, wherein the main body part is configured by a heat pipe.

6. The humidity control apparatus according to claim 1, wherein the main body part is configured by a meandering capillary tube heat pipe or an oscillating heat pipe.

7. An environment test apparatus, comprising the humidity control apparatus described in claim 1.

8. A temperature and humidity control apparatus having the humidity control apparatus described in claim 1, the temperature and humidity control apparatus comprising:

a temperature control unit for controlling a temperature of the air, wherein the humidity of the humidity control space is controlled by the humidity control apparatus, and the temperature of the humidity control space is controlled by the temperature control unit.

* * * * *